United States Patent [19]

McCarty

[11] 4,293,888

[45] Oct. 6, 1981

[54] PRINT HAMMER DRIVE CIRCUIT WITH COMPENSATION FOR VOLTAGE VARIATION

[75] Inventor: Vincent D. McCarty, Austin, Tex.

[73] Assignee: International Business Machines Corporation, Armonk, N.Y.

[21] Appl. No.: 51,580

[22] Filed: Jun. 25, 1979

[51] Int. Cl.[3] ..... H01H 47/32

[52] U.S. Cl. ..... 361/152; 361/154; 361/100; 101/93.03; 400/144.2; 400/166; 400/157.3

[58] Field of Search ..... 361/154, 152; 101/93.03, 93.48; 400/144.2, 144.3, 166, 157.3

[56] References Cited

U.S. PATENT DOCUMENTS

| | | | |
|---|---|---|---|
| 3,628,102 | 12/1971 | Jauch et al. | 361/154 |
| 3,712,212 | 1/1973 | Beery | 101/93 |
| 3,786,314 | 1/1974 | Misch | 361/154 |
| 3,789,272 | 1/1974 | Vollhardt | 361/154 |
| 3,866,533 | 2/1975 | Gilbert et al. | 101/93.14 |
| 4,030,591 | 6/1977 | Martin et al. | 400/144.2 |
| 4,156,885 | 5/1979 | Baker et al. | 361/100 |
| 4,173,030 | 10/1979 | Rabe | 361/154 |
| 4,176,387 | 11/1979 | Harper | 361/154 |

*Primary Examiner*—Edward M. Coven
*Attorney, Agent, or Firm*—John L. Jackson

[57] ABSTRACT

A print hammer drive circuit is driven by a voltage supply having inherent voltage variations. The driving current is applied to the print hammer coil and the level of the current in the coil detected. After the level of the current in the coil reaches a predetermined maximum level a timing circuit is initiated to control the duration of application of maximum current. Variations in supply voltage on the duration and force of strike of the print hammer have greatly reduced since all timing is based relative to the time that the predetermined drive current level is achieved as distinguished from timing which includes the rise time of the driving current wave form. Also the effects of variations in inductance from coil to coil can be compensated for by adjustment of the timing circuit.

2 Claims, 5 Drawing Figures

PRINT HAMMER DRIVE CIRCUIT WITH COMPENSATION FOR VOLTAGE VARIATION

BACKGROUND OF THE INVENTION

1. Field of the Invention

This invention relates to solenoid drive systems in general and more particularly, to those systems which include a solenoid drive system in which accurate control of the duration and force of the output of the solenoid, irrespective of voltage variations, is required. More specifically, this invention relates to the accurate control of a high speed impact solenoid driven printer to provide accuracy of control for print quality purposes.

2. Description of the Prior Art

Printers which use the so-called daisy wheel and high speed impact hammer principle are well known and are currently commercially available.

Accurate control of the printer is required to provide good print quality. Several techniques have been employed to analyze and thus control the force, flight time and duration of force of a print hammer. These variables have been applied in accordance with the print area to be printed, the number of forms to printed, etc. Following are some of the issued patents which have approached the hammer control problem.

Berry, U.S. Pat. No. 3,712,212, filed Nov. 12, 1971, issued Jan. 23, 1973 is illustrative of an impact printer in which the force for printing is varied in accordance with the surface area of the character being printed. In Berry a rotary print wheel or drum or an endless belt is used and one or more print hammers are cooperable with the member to print upon the print media. The electromagnetic field produced by a solenoid, as is typical, initiates the flight of the hammer against a document. While Berry addresses the problem of hammer impact based on surface area, no attempt is made in Berry to control the hammer force to compensate for voltage supply variations. Instead, the pulse applied to the solenoid coil of the print hammer is timed from the application of the pulse without any consideration given to any variation in the rise time of the pulse occasioned by fluctuations in power supply voltage or inductance variations.

U.S. Pat. No. 3,866,533 to Gilbert, et al, filed Dec. 26, 1972, issued Feb. 18, 1975 is another system for varying the impact of a print hammer. In this system the width of the pulse applied to the print hammer solenoid is varied in accordance with the thickness of forms on which printing is being performed. Secondarily, in this patent there is taught a smoothing technique for smoothing the input voltage to minimize the print hammer impact variations. In this patent, however, there is no technique taught of timing the print pulse from the time that a predetermined current level is reached in the solenoid coil to overcome voltage variation problems.

U.S. Pat. No. 4,030,591 to Martin, et al, filed Sept. 25, 1975, issued June 21, 1977 again shows a print hammer control circuit. In this system the print hammer is timed dependent on printing speed. Again, the hammer firing occurs based on the time that a pulse is received. The timing of the pulse is based on the printing speed. No attempt is made to exercise any control over the hammer after the gating pulse has been received. Likewise, the duration of the pulse is timed from the initiation of the current in the hammer coil and is not timed from the point that the current in the coil reaches a predetermined level. Thus, rise time variations can adversely affect the Martin system.

BRIEF DESCRIPTION OF PRESENT INVENTION

A solenoid drive circuit is driven by a voltage supply having inherent voltage variations. The driving current is applied to the print hammer coil and the level of the current in the coil detected. After the level of the current in the coil reaches a predetermined maximum level a timing circuit is initiated to control the duration of application of the maximum current. Variations in supply voltage have little effect on the net electromagnetic field produced by the coil since all timing is based relative to the time that the predetermined drive current level is achieved as distinguished from timing which includes the rise time of the driving current wave form. Likewise, through use of proper timing the effects of inductance changes in solenoid type systems can be compensated for.

In the preferred embodiment the solenoid drive circuit is employed in a daisy wheel printer application to accurately control the flight time, impact force and duration of force of a print hammer mounted in the coil.

BRIEF DESCRIPTION OF THE DRAWING

Referring now to the drawings, wherein a preferred embodiment of the invention is illustrated, and wherein like reference numerals are used throughout to designate like parts.

DETAILED DESCRIPTION OF PREFERRED EMBODIMENT

Figure 1:
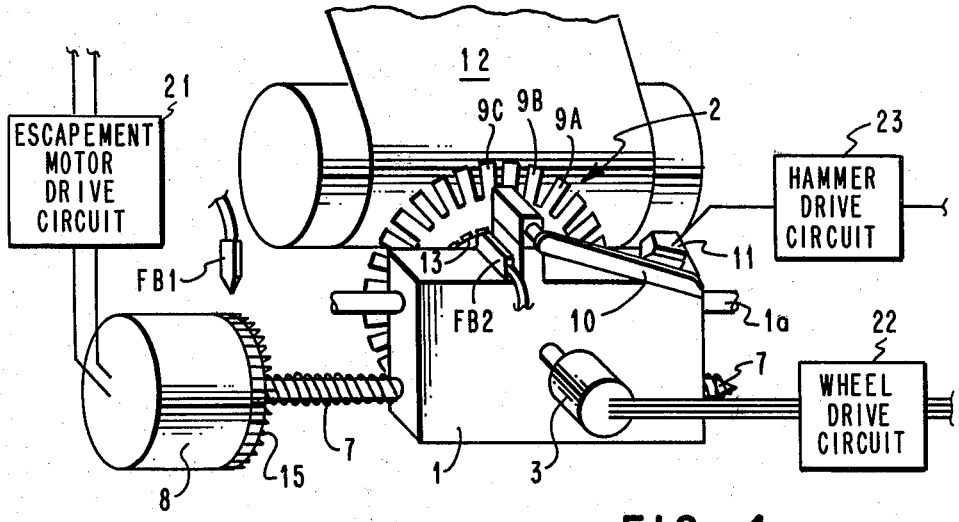
FIG. 1 shows a printer apparatus for use with the present invention.

FIG. 1 shows for purposes of an illustrated use of the subject invention, the main mechanical components of a printing system. They are shown somewhat schematically since such components are well known and the present invention is directed toward the control system for the hammer drive circuit. Obviously, other applications for control of a solenoid applied force exist.

As shown in FIG. 1, a laterally sliding carrier 1 is mounted on a guide rod 1*a* and a lead screw 7 and carries a rotatable print wheel or disk 2 driven by a stepping motor 3. The carrier 1 is driven by lead screw 7 which is driven by a stepping motor 8. Alternatively, motor 8 could drive a belt which in turn could drive carrier 1. A type disk 2 comprises a disk having a number of movable type elements such as the flexible spokes or type fingers 9A, 9B, 9C, etc. Printing of any desired character is brought about by operating a print hammer 10, which is actuated by a solenoid 11, both of which are mounted on carrier 1. When the appropriate type finger approaches the print position, solenoid 11 actuates hammer 10 into contact with the selected type finger, driving it into contact with a paper 12 or other printing medium. An emitter wheel 13 attached to and rotating with type disk 2 cooperates with a sensor FB2 to produce a stream of emitter index pulses for controlling the operation of the printer. The emitter has a series of teeth each of which correspond to one finger 9A, 9B, 9C, etc. A homing pulse is generated for each revolution of the print wheel by a single tooth on another emitter (not shown). The printer control can thus determine the angular position of type disk 2 at any time by counting the pulses received since the last homing pulse. A toothed emitter 15 is mounted on the shaft of the motor 8 and in conjunction with a sensor FB1 provides pulses which indicate the position of the carrier 1.

Stepper motors 3 and 8 are activated by conventional drive circuits 21 and 22. Examples of the type of drive circuitry that could be used are shown in U.S. Pat. No. 3,636,429. A hammer solenoid 11 is actuated by a hammer drive circuit 23 which is the subject of the present application.

Figure 2:
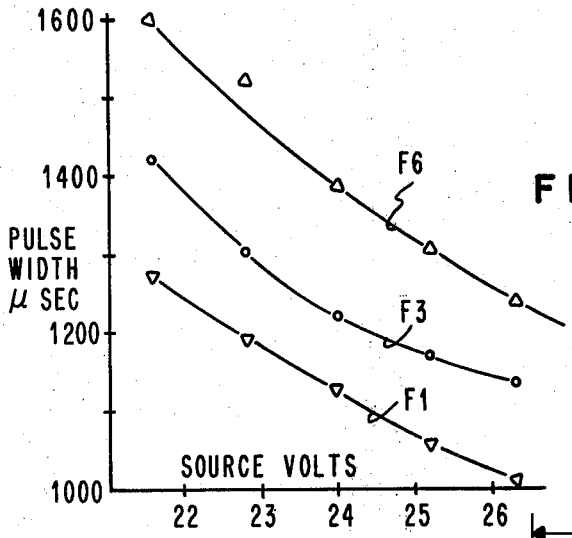
FIG. 2 is a graph illustrating the effect of voltage variations on current rise time in a solenoid hammer system.

Refer next to FIG. 2. FIG. 2 is a reproduction from the aforementioned Gilbert Pat. No. 3,866,533. FIG. 2 is included to illustrate the variation in pulse width occasioned by voltage variations from the power supply. The wave forms shown in FIG. 3 as taken from U.S. Pat. No. 3,866,533 are for one, three and six part forms. However, referring to the wave form labeled F1 for purposes of illustration, it can be seen that variation in the voltage supply from 22 to 23 volts results in a pulse width variation of almost 100 microseconds. As previously discussed, while prior systems have attempted to vary the duration of the pulse applied to the solenoid driving of the print hammer to compensate for print variations, number of forms, etc., once the input pulse has been applied to the solenoid it has been timed from the initiation of the pulse to the solenoid coil without any consideration given as to the affect on the duration of the pulse occasioned by voltage supply variations during the rise time of the pulse.

Figure 3:
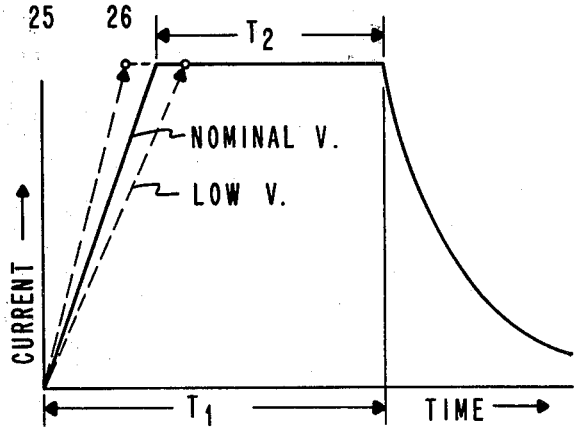
FIG. 3 is a graph illustrating the variations in rise time occasioned by voltage supply and inductance variations.

In FIG. 3 there is shown a graph illustrating the problem associated with variations in voltage supply during the rise time of the pulse which occur when the pulse is timed from the time of application of voltage to the coil. As shown in FIG. 3 a relatively high voltage applied to the coil will obviously result in a relatively rapid rise time which in turn will cause the time T1 to be, as shown, relatively large as compared to the time of the wave form T2 which is measured from the time that the current in the coil reaches a predetermined level. Further as shown in FIG. 3, a relatively low voltage applied to the coil will result in current to the coil being relatively small as compared to time of T2. The graph of FIG. 3 is shown merely to illustrate that voltage variations during the rise time of the wave form can cause significant variations in the time that the maximum current is applied to the coil. These rise times result in an unpredictable time of application of maximum current to the coil which in turn causes extreme problems in hammer control. In accordance with the present invention the timing of the application of the wave form to the coil is from the time that the wave form reaches its maximum selected current as distinguished from the time that the current is initially applied to the coil as in prior art systems. It has been shown that extremely accurate control over the electromagnetic field produced can be obtained by timing the maximum current in the coil as distinguished from timing from initial application of the current to the coil.

Figure 4:
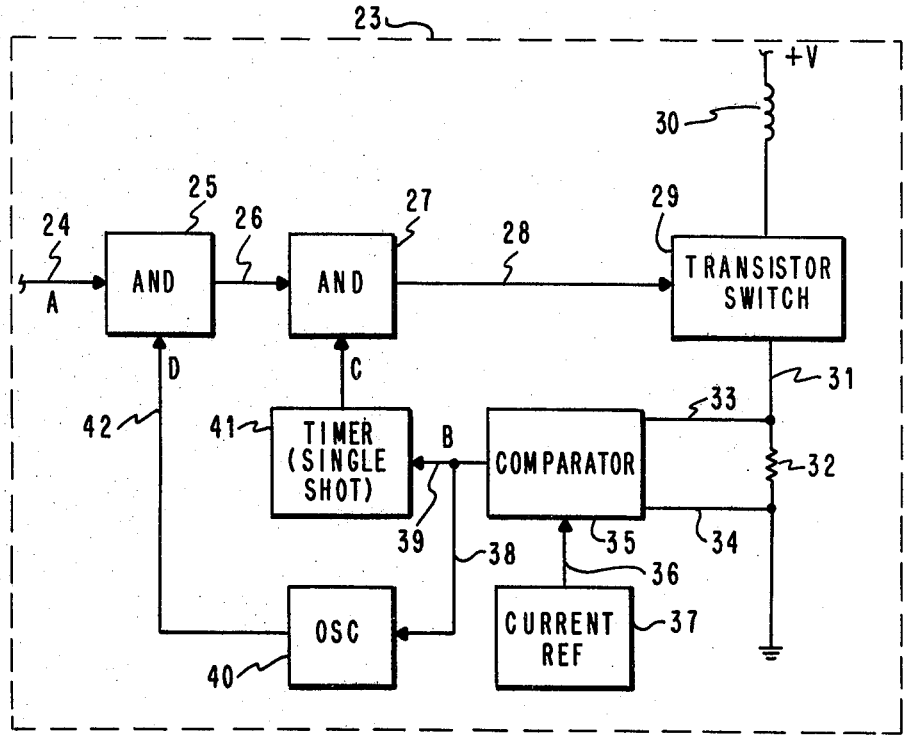
FIG. 4 is a block diagram of the solenoid drive circuit which is the subject of the present invention.

Refer next to FIG. 4 where in is illustrated an example of the circuit for allowing timing for a preselected time of a wave form to a coil from the time that it reaches a maximum preselected current. As shown in FIG. 4, AND gate 25 receives a signal A along line 24. Signal A is merely the control signal from the system indicating that the hammer is to be fired. The AND gate receives its other enabling signal D along line 42. The D signal will be developed later. The output of AND gate 25 is applied along line 26 to AND gate 27. AND gate 27 receives its other enabling input C from timer 41. AND gate 27 provides an output along line 28 to transistor switch 29. Transistor switch 29 is merely a conventional current transistor switch. Transistor switch 29 is operative to provide ground to the coil 30. Transistor switch 29 is likewise coupled along line 31 through resistor 32 to ground to complete the coil current circuit. Resistor 32 is a sense resistor which has the current flow through it sensed along lines 33 and 34 which are applied to a comparator 35. Comparator 35 also receives an input along line 36 from a current reference 37. The current reference 37 is a predetermined current reference which the current flowing through the sense resistor 32 is compared against. When the current through resistor 32 is equal to the current reference 37 a compare is made and an output signal B is produced. This output signal is applied to timer 41 and along line 39 and applied along line 38 to oscillator 40. The output of oscillator 40 is applied to line 42.

Figure 5:
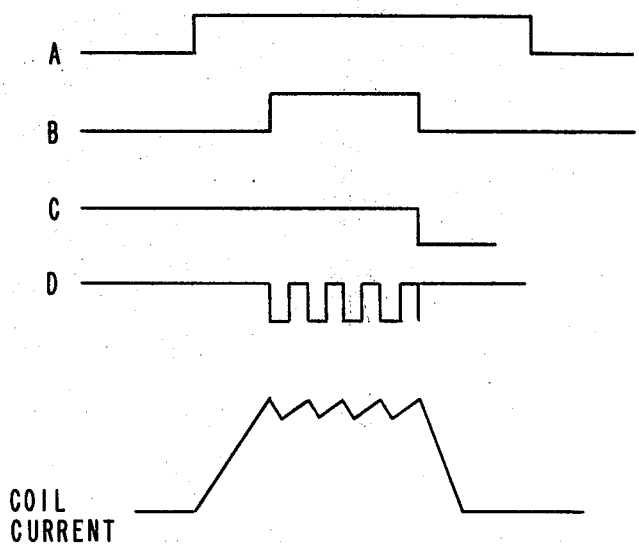
FIG. 5 are wave forms associated with the solenoid drive circuit of FIG. 4.

In operation, referring to the wave forms of FIG. 5, the circuit of FIG. 4 operates as follows. The initiation signal from the system control logic of the printer or other system is applied along line 24 to AND gate 25. This signal is shown as A in FIG. 5. At this time, as shown, the signal C from the single shot timer 41 is up and, therefore, AND gate 25 comes true applying a positive logical level along line 26 to AND gate 27. The other input to AND gate 27 is the C signal from timer 41. Again, as shown, the C signal from timer 41 at this time is a positive logical level which causes a positive logical level to be applied along line 28 to the transistor switch 29. Transistor switch 29 again is a conventional transistor switch and application of a positive potential along line 28 causes the transistor to conduct to apply current through coil 30 from the positive potential to ground. Thus, current begins to flow through coil 30 which is the drive coil of the solenoid. As current flows through coil 30 to ground it passes through resistor 32 which, as previously stated, is a sense resistor. The current flowing through sense resistor 32 is applied to comparator 35 and compared against the current reference applied along line 36 from current reference 37. When the current through resistor 32, and therefore through coil 30, reaches the current reference level the comparator 35 provides the B signal which is applied along line 38 to the oscillator 40 and along line 39 to the timer 41. At this time timer 41 will begin to time out based on the time selected. As shown, for simplicity, it is a single shot and the time selected will be that required for the systems application. Likewise, the signal B applied along line 38 will cause oscillator 40 to begin to oscillate. The purpose of oscillator 40 obviously is to provide gating pulses to the system to prevent current overshoot. Thus, it operates to, along line 42, to turn AND gate 25 and, therefore, transistor 29 on and off to provide the saw tooth coil current wave form as shown in FIG. 5. Finally, after timer 41 times out based on the preselected value, its output C falls to a negative level which causes AND gate 27 to apply a low logical level along line 28 to cause transistor switch 29 to turn off dropping current through coil 30.

Representative values for certain of the components and wave forms illustrated in FIGS. 4 and 5 are as follows:

| | |
|---|---|
| Coil 30 | 200 turns #22 copper wire, ≃ .6 Ohms |
| Resister 32 | 0.5 Ohms |
| Coil current | 7a, peak to peak |
| Signal B | 1.5 ms |
| Oscillator 40 | 40 Khz |

In summary, a print hammer drive circuit is driven by a voltage supply having inherent voltage variations. The driving wave form is applied to the print hammer coil and the level of the current in the coil detected. After the level of the current in the coil reaches a predetermined level the timing circuit is initiated to time the length of the wave form. Variations in supply voltage do not affect the print hammer since all timing is based relative to the time that the predetermined drive current level is achieved as distinguished from timing which includes the rise time of the driving current wave form. Likewise inductance variations can be compensated for by varying the duration of the current pulse.

While the invention has been particularly shown and described with reference to a particular embodiment, it will be understood by those skilled in the art that various changes in form and detail may be made without departing from the spirit and scope of the invention.

What is claimed is:

1. A control circuit for a solenoid for controlling the application of a current of a preselected magnitude to the coil of the solenoid for a preselected time, said circuit comprising:

a current source selectively connected to said coil;

means for connecting said current source to said coil; and means for interrupting current to said coil a predetermined time after said current in said coil has reached a predetermined level;

said interrupting means including a current sensor for sensing said predetermined level, a current reference source and a comparator connected to both said current sensor and said current reference source.

2. The control circuit of claim 1 wherein a timer is connected to said current sensor which senses said predetermined level operative to disconnect said current from said coil a predetermined time after said current has reached said predetermined level.

* * * * *